US006386825B1

(12) United States Patent
Burdgick

(10) Patent No.: US 6,386,825 B1
(45) **Date of Patent: *May 14, 2002**

(54) APPARATUS AND METHODS FOR IMPINGEMENT COOLING OF A SIDE WALL OF A TURBINE NOZZLE SEGMENT

(75) Inventor: Steven Sebastian Burdgick, Schenectady, NY (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/546,770

(22) Filed: Apr. 11, 2000

(51) Int. Cl.[7] ..... F01D 9/06
(52) U.S. Cl. ..... 415/116; 415/139
(58) Field of Search ..... 415/114, 115, 415/116, 117, 138, 139; 416/96 R, 96 A, 97 R

(56) References Cited

U.S. PATENT DOCUMENTS

| | | | | |
|---|---|---|---|---|
| 3,807,892 A | * | 4/1974 | Frei et al. | 415/116 |
| 5,116,199 A | * | 5/1992 | Ciokajlo | 415/116 |
| 5,223,320 A | * | 6/1993 | Richardson | 416/97 R |
| 5,823,741 A | * | 10/1998 | Predmore et al. | 415/139 |
| 6,126,389 A | * | 10/2000 | Burdgick | 415/115 |

OTHER PUBLICATIONS

"39$^{th}$ GE Turbine State–of–the–Art Technology Seminar", Tab ""F" Technology –the First Half–Million Operating Hour", H. E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA –An Advanced Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines –Design and Operating Features", M.W. Horner, Aug. 1996.

"39th GE Turbine State–of–the–Art Technology Seminar", Tab 7, "Advance Gas Turbine Materials and Coatings", P.W. Schilke, Aug. 1996.

"39th GE Turbine State–of–the–Art Technology Seminar", Tab 8, "Dry Low $NO_x$ Combustion Systems for GE Heavy–Duty Turbines", L. B. Davis, Aug. 1996.

(List continued on next page.)

*Primary Examiner*—Christopher Verdier
(74) *Attorney, Agent, or Firm*—Nixon & Vanderhye PC

(57) ABSTRACT

A gas turbine nozzle segment has outer and inner bands and a vane therebetween. Each band includes a nozzle wall, a side wall, a cover and an impingement plate between the cover and the nozzle wall defining two cavities on opposite sides of the impingement plate. Cooling steam is supplied to one cavity for flow through apertures of the impingement plate to cool the nozzle wall. The side wall of the band and inturned flange define with the nozzle wall an undercut region. The impingement plate has a turned flange welded to the inturned flange. A backing plate overlies the turned flange and aligned apertures are formed through the backing plate and turned flange to direct and focus cooling flow onto the side wall of the nozzle segment.

9 Claims, 2 Drawing Sheets

OTHER PUBLICATIONS

"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up Systems Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al. Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14 "Gas Turbine Conversions, Modifications and Uprates Technology", Stuck et al. Aug. 1996.
"39th GE Turbine State–of–the–Art Technology Seminar", Tab 15, "Performance and Reliability Improvements for Heavy–Duty Gas Turbines," J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery Systems and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al. Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for Stag™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al. Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology", J. F. Nolan, Aug. 1996.
"39th GE Turbine State–of–the–Art Technology Seminar", Tab 34, "Operation and Maintenace Strategies to Enhance Plant Profitability", MacGillivary et al., Aug. 1996.
"39th GE Turbine State–of–the–Art Technology Seminar", Tab 35, "Generator Insitu Inspection", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al. Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program –Conceptual Design and Product Development", Annual Report, Sep. 1, 1994 – Aug. 31, 1995.
"Advanced Turbine Systems (ATS Program) Conceptual Design and Product Development", Final Technical Progress Report, Vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993 –Aug. 31, 1994.
"Advanced Turbine Systems"Annual Program Review, Preprints, Nov. 2–4, 1998, Washington D.C. U.S. Department of Engery, Office of Industrial Technologies Federal Energy Technology Center.
"ATS Conference " Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176—11.
"Exhibit panels used at 1995 product introduction at PowerGen Europe".

"Extensive Testing Program Validates High Efficiency, reliability of GE's Advanced "H" Gas Turbine Technolgoy", Press Information, Press Release, (96–NR14, Jun. 26, 1996, H Technolgy Tests/pp. 1–4.
"Extensive Testing Program Validates High Efficiency, Reliability of GE's Advanced "H" Gas TurbineTechnology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Shares Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar. 1998.
"H Technology", Jon Ebacher, VP, Power Gen Technology, May 8, 1998.
"H Testing Process", Jon Ebacher, VP Power Gen Technology, May 8. 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency for GE "H" Technology Combined–Cycle Systems", Press Information, Press Release, 95–NRR16, May 16, 1995 H Technology/pp. 1–3.
"Overview of GE's H Gas Turbine Combined Cycle", Jul. 1, 1995 to Dec. 31, 1997.
"Power Systems for the 21st Century –"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement", various newspaper clippings relating to improved generator.
"Proceedings of the Advanced Turbine Systems Annual Program Review Meeting", vol. I, "Industrial Advanced Turbine Systems Program Overview", D. W. Esbeck, pp. 3–13, Oct., 1995.
"Proceedings of the Advanced Turbine Systems Annual Program Review Meeting", vol. I, "H Gas Turbine Combined Cycle", J. Corman pp.14–21, Oct., 1995.
"Proceedings of the Advanced Turbine Systems Annual Program Review Meeting", vol. I, "Overview of Westinghouse's Advanced Turbine Systems Program", Bannister et al., pp. 22–30, Oct., 1995.
"Proceedings of the Advanced Turbine Systems Annual Program Review Meeting", vol. I, "Allison Engine ATS Program Technical Review", pp. 31–42, Oct., 1995.
"Proceedings of the Advanced Turbine Systems Annual Program Review Meeting", vol. I, "Advanced Turbine Systems Program Industrial System Concept Development", S. Gates, pp. 43–63, Oct., 1995.
"Proceedings of the Advanced Turbine Systems Annual Program Review Meeting", vol. I, "Advanced Turbine Systems Program Phase 2 Cycle Selection", Latcovich, Jr. pp. 64–69, Oct., 1995.
"Proceedings of the Advanced Turbine Systems Annual Program Review Meeting", vol. I, "General Electric ATS Program Technical Review Phase 2 Activities", Chance et al., pp. 70–74, Oct., 1995.
"Proceedings of the Advanced Turbine Systems Annual Program Review Meeting", vol. I, "Technical Review of Westinghouse's Advanced Turbine Systems Program", Diakunchak et al., pp.75–86, Oct., 1995.
"Proceedings of the Advanced Turbine Systems Annual Program Review Meeting", vol. I, "Advanced Combustion Turbines and Cycles: An EPRI Perspective", Touchton et al., pp.87–88, Oct., 1995.
"Proceedings of the Advanced Turbine Systems Annual Program Review Meeting", vol. I, "Advanced Turbine Systems Annual Program Review", William E. Koop, pp. 89–92. Oct., 1995.
"Proceedings of the Advanced Turbine Systems Annual Program Review Meeting", vol. I, "The AGTSR Consortium: An Update", Fant el al., pp. 93–102, Oct., 1995.
"Proceedings of the Advanced Turbine Systems Annual Program Review Meeting", vol. I "Overview of Allison/AGTSR Interactions", Sy A. Ali, pp. 103–106, Oct., 1995.
"Proceedings of the Advanced Turbine Systems Annual Program Review Meeting", vol. I "Design Factors for Stable Lean Premix Combustion", Richard et al., pp. 107–113, Oct., 1995.
"Proceedings of the Advanced Turbine Systems Annual Program Review Meeting", vol. I "Ceramic Stationary as Turbine", M. van Roode, pp. 114–147, Oct., 1995.
"Proceedings of the Advanced Turbine Systems Annual Program Review Meeting", vol. I, "DOE/Allison Ceramic Vane Effort", Wenglarz et al., pp. 148–151, Oct 1995.
"Proceedings of the Advanced Turbine Systems Annual Program Review Meeting", vol. I, "Materials/Manufacturing Elements of the Advanced Turbine Systems Program", Karnitz et al. pp. 152–160, Oct., 1995.
"Proceedings of the Advanced Turbine Systems Annual Program Review Meeting", vol. I "Land–Base Turbine Casting Initiative", Mueller et al., pp. 161–170, Oct., 1995.
"Proceedings of the Advanced Turbine Systems Annual Program Review Meeting", vol. I "Turbine Airfoil Manufacturing Technology", Kortovich, pp. 171–181, Oct., 1995.
"Proceedings of the Advanced Turbine Systems Annual Program Review Meeting", vol. I "Pratt & Whitney Thermal Barrier Coatings", Bornstein et al., pp. 182–193, Oct., 1995.
"Proceedings of the Advanced Turbine Systems Annual Program Review Meeting", vol. I "Westinghouse Thermal Barrier Coatings", Goedjen et al., pp. 194–199, Oct., 1995.
"Proceedings of the Advanced Turbine Systems Annual Program Review Meeting", vol. I, "High Performance Steam Development", Duffy et al., pp. 200–220, Oct., 1995.
"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct. 1995.

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames for Low $No_x$ Combustors", Sojka et al. pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309,Oct., 1995.

"Proceedings of the Advanced Turbine Systems Annual Program Review Meeting", vol.II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smooth et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol.II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Coating Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine Systems", William D. Weisbrod, pp. 73–94, Nov., 1996.

"Proceedings of the Advanced Turbine Systems Annual Program Review Meeting", "the AGTSR Industry–University Consortium", Lawrence P. Golan, pp. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "The Role of Reactant Unmixedness, Strain Rate, and Lenth Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_x$ Turbines, Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applicants", Thong Q. Dang, pp. 393–406, Nov., 1996.

"Proceeding of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharaya, pp. 427–446.

"Proceedings of the Advanced Turbine Systems Annual Program Review Meeting", "Experimental Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov.,1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annaul Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heating Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535,–552 Nov., 1996.

"Proceedings of the Advanced Turbine Systems Annual Program Review Meeting", "ATS Materials Support", Michael Karnitz, pp. 553–576, Nov., 1996.

"Proceedings of the Advanced Turbine Systems Annual Program Review Meeting", "Land Based Turbine Casting Initiative", Boyd A. Mueller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.

"Proceedings of the Advanced Turbine Systems Annual Program Review Meeting", "Hot Corrosion Testing of TBS's", Norman Bornstein, pp. 623–631, Nov., 1996.

"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov.,1996.
"Status Report: The U.S. Department of Energy's Advanced Turbine systems Program", facsimile dated Nov. 7,1996.
"Testing Program Results Validate GE's H Gas Turbine – High Efficiency, Low Cost of Electricity and Low Emissons", Roger Schonewald and Patrick Marolda, (no date available).
"Testing Program Results Validate GE's H Gas Turbine – High Efficiency, Low Cost of Electricity and Low Emissions", Slide Presentation –working draft, (no date available).
"The Next Step In H... For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31,1996, Publication Date, Jun. 1, 1997, Report Numbers: DOE/MC/31176—5628.
"Utility Advanced Turbine System (ATS) Technology Readiness Testing —Phase 3", Document #666274, Oct. 1, 1996–Sep. 30, 1997, Publication Date, Dec. 31, 1997, Report Numbers: DOE/MC/31176—10.
"Utility Advanced Turbine System (ATS) Technology Readiness Testing and Pre–Commercial Demonstration, Phase 3", Document #486029, Oct. 1 –Dec. 31, 1995, Publication Date May 1, 1997, Report Numbers: DOE/MC/31176—5340.
"Utility Advanced Turbine System (ATS) Technology Readiness Testing and Pre–Commerical Demonstration –Phase 3", Document #486132, Apr. 1 –Jun. 30, 1976, Publication Date, Dec. 31, 1996, Report Numbers: DOE/MC311176—5660.
"Utility Advanced Turbine System (ATS) Technology Readiness Testing and Pre–Commerical Demonstration — Phase 3", Document #587906, Jul. 1 –Sep. 30, 1995, Publication Date, Dec. 31, 1995, Report Numbers: DOE/MC/31176—5339.
"Utility Advanced Turbine System (ATS) Technology Readiness Testing and Pre–Commerical Demonstration", Document #666277, Apr. 1 –Jun. 30, 1997, Publication Date, Dec. 31, 1997, Report Numbers:DOE/MC31176—8.
"Utility Advanced Turbine System (ATS) Technology Readiness and Pre–Commericalization Demonstration" Jan. 1 –Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Numbers: DE—FC21–95MC/31176–23.
"Utility Advanced Turbine System(ATS) Technology Readiness Testing", Document#656823, Jan. 1 –Mar. 31, 1998, Publication Date Aug. 1, 1998, Report Numbers: DOE/MC/31176–17.
"Utility Advanced Turbine Systems (ATS) Technology Readiness Testing and Pre–Commerical Demonstration", Annual Technical Progress Report, Reporting Period: Jul. 1, 1995 –Sep. 30, 1996.
"Utility Advanced Turbine Systems (ATS) Technology Readiness Testing", Phase 3R, Annual Technical Progress Report, Reporting Period: Oct. 1, 1997 –Sep. 30, 1998.
"Utility Advanced Turbine Systems (ATS) Technology Readiness Testing", Document #750405, Oct. 1 –Dec. 30, 1998, Publication date: May 1, 1999, Report Numbers: DE–FC21–95MC31176–20.
"Utility Advanced Turbine Systems (ATS) Technology Readiness Testing", Document #1348, Apr. 1 –Jun. 29, 1998, Publication Date Oct. 29, 1998, Report Number DE–FC21–95MC31176—18.
"Utility Advanced Turbine Systems (ATS) Technology Readiness Testing –Phase 3", Annual Technical Progress Report, Reporting Period: Oct. 1, 1996 –Sep. 30, 1997.
"Utility Advanced Turbine Systems (ATS) Technology Readiness Testing and Pre–Commerical Demonstration", Quarterly Report, Jan. 1 –Mar. 31, 1997, Document #666275, Report Numbers: DOE/MC/31176–07.
"Proceeding of the 1997 Advanced Turbine Systems", Annual Review Meeting, Oct. 28–29, 1997.

* cited by examiner

APPARATUS AND METHODS FOR IMPINGEMENT COOLING OF A SIDE WALL OF A TURBINE NOZZLE SEGMENT

This invention was made with Government support under Contract No. DE-FC21-95MC311876 awarded by the Department of Energy. The Government has certain rights in this invention.

BACKGROUND OF THE INVENTION

The present invention relates to impingement cooling of a gas turbine nozzle band side wall of a nozzle segment and particularly relates to impingement cooling of a nozzle band side wall in the undercut region of a nozzle segment wherein the weld joint between the nozzle segment cover and the nozzle side wall is remote from the nozzle wall exposed to the hot gas path.

In current gas turbine designs, nozzle segments are typically arranged in an annular array about the rotary axis of the turbine. The array of segments forms outer and inner annular bands and a plurality of vanes extend between the bands. The bands and vanes define in part the hot gas path through the gas turbine. Each nozzle segment comprises an outer band portion and an inner band portion and one or more nozzle vanes extend between the outer and inner band portions. In current gas turbine designs, a cooling medium, for example, steam, is supplied to each of the nozzle segments to cool the parts exposed to the hot gas path. To accommodate the steam cooling, each band portion includes a nozzle wall in part defining the hot gas path through the turbine, a cover radially spaced from the nozzle wall defining a chamber therewith and an impingement plate disposed in the chamber. The impingement plate defines with the cover a first cavity on one side thereof for receiving cooling steam from a cooling steam inlet. The impingement plate also defines, along an opposite side thereof and with the nozzle wall, a second cavity. The impingement plate has a plurality of apertures for flowing the cooling steam from the first cavity into the second cavity for impingement cooling the nozzle wall. The cooling steam then flows radially inwardly through cavities in the vane(s), certain of which include inserts with apertures for impingement cooling the side walls of the vane. The cooling steam then enters a chamber in the inner band portion and reverses its flow direction for flow radially outwardly through an impingement plate for impingement cooling the nozzle wall of the inner band. The spent cooling medium flows back through a cavity in the vane to an exhaust port of the nozzle segment.

The cover provided in each of the outer and inner band portions is preferably welded to the corresponding nozzle side wall. In prior designs, the weld joint between the cover and the nozzle side wall was disposed at a radial location between the nozzle wall and the spline seal between side walls of adjacent nozzle segments. In that location, the weld was exposed to the high temperature gases in the hot gas flow path and was very difficult to cool. Thus, weld joint fatigue life was significantly reduced due to its proximity to the hot gas path. Moreover, the location of the weld was not optimum for manufacturing repeatability and was very sensitive to manufacturing tolerances. The weld joint was characterized by variable wall thicknesses which increased the stress at the joint, decreased the low cycle fatigue and limited the life of the parts. The wall thickness at the weld after machining was also a variable which could not be tolerated in the manufacturing process.

BRIEF SUMMARY OF THE INVENTION

In accordance with a preferred embodiment of the present invention, a cooling system is provided in a nozzle segment in which the weld joint between the cover and nozzle wall is on the side of the spline seal remote from the nozzle wall exposed to the hot gas path. That is, the weld joint between the cover and the nozzle side wall of the outer band is located radially outwardly of the spline seal between adjacent outer bands while the weld joint between the cover and the nozzle side wall of the inner band is located radially inwardly of the spline seal between adjacent inner bands. This reduces the temperature of the weld joints during turbine operation, reduces the stresses across the joints, both thermal and mechanical, eliminates any requirement for machining after welding and results in joints of constant thickness and higher fatigue life. The location also leads to improved machinability and tolerance to weld defects.

To provide that weld location, undercut regions adjacent the side walls of the nozzle segment bands are formed. Particularly, each undercut region includes a side wall or edge of the nozzle segment and an inturned flange extending inwardly from and generally parallel to and spaced from the nozzle wall. Cooling the nozzle band side wall or edge, however, is quite difficult in view of the undercut region which distances the side wall or edge from the impingement plate. This large distance reduces the effectiveness of cooling the nozzle side wall by impingement cooling flow through apertures in the impingement plate.

In accordance with the present invention, improved side wall fabrication and cooling is provided. Particularly, with the weld joint between the cover and the nozzle side wall located remotely from the hot gas path through the turbine, side wall cooling is improved by providing a backing plate for the impingement plate with apertures through the backing plate aligned with apertures through the impingement plate for directing impingement cooling flow onto the side wall. Particularly, the impingement plate is provided with a turned edge. Margins of the edge are secured, for example, by welding to the prepared face of the inturned flange of the nozzle segment side wall, leaving a portion of the turned edge of the impingement plate extending generally parallel to the nozzle segment side wall. To more directly target or focus the impingement cooling medium flowing through the apertures of the turned edge, a backing plate having apertures aligned with the apertures through the turned edge of the impingement plate is secured along the turned edge. As a consequence, the length-to-diameter ratio of the aligned apertures is improved, thereby enabling direct targeting or focusing of the cooling flow onto the side wall of the nozzle segment. The backing plate also adds additional strength about the perimeter of the impingement plate.

The foregoing cooling system is readily and easily fabricated. For example, the backing plate is added to the turned flange of the impingement plate and apertures are then provided simultaneously through the backing plate and turned edge. The impingement plate is then placed into the nozzle segment and tacked into position and later welded or brazed into the nozzle segment.

In a preferred embodiment according to the present invention, there is provided for use in a gas turbine, a nozzle segment having outer and inner band portions and at least one vane extending between the band portions, at least one of the band portions having a nozzle wall defining in part a hot gas path through the turbine, a cover radially spaced from the nozzle wall defining a chamber therebetween and an impingement plate secured within the segment and disposed in the chamber defining with the cover a first cavity on one side thereof for receiving a cooling medium, the impingement plate on an opposite side thereof defining with the nozzle wall a second cavity, the impingement plate having a plurality of apertures therethrough for flowing cooling medium from the first cavity into the second cavity for impingement cooling the nozzle wall, the nozzle segment including a side wall extending generally radially between the nozzle wall and the cover and having an inturned flange, the inturned flange defining an undercut region adjacent the side wall, and a backing plate overlying a portion of the impingement plate, the backing plate and the impingement plate portion having aligned apertures therethrough for directing a flow of the cooling medium onto the side wall for impingement cooling thereof.

DETAILED DESCRIPTION OF THE INVENTION

Figure 1:
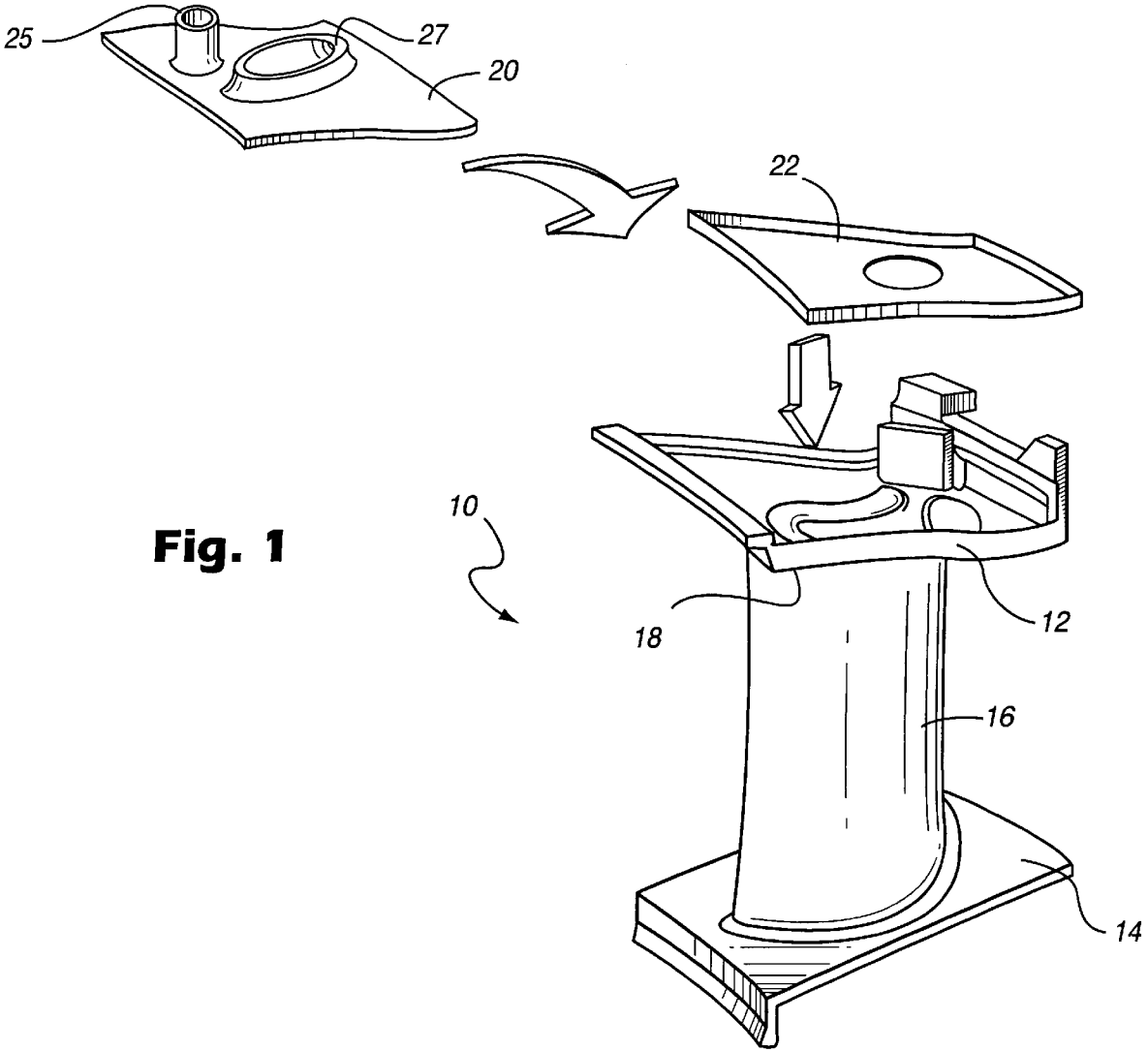
FIG. 1 is an exploded perspective and schematic view of a nozzle segment constructed in accordance with the present invention.

Referring now to FIG. 1, there is illustrated a nozzle segment, generally designated 10, forming a part of an annular array of segments disposed about a gas turbine axis. Each nozzle segment includes an outer band 12, an inner band 14 and one or more vanes 16 extending therebetween. When the nozzle segments are arranged in the annular array, the outer and inner bands 12 and 14 and vanes 16 in part define an annular hot gas path through the gas turbine, as is conventional.

The outer and inner bands and the vanes are cooled by flowing a cooling medium, e.g., steam, through a chamber in the outer band 12, radially inwardly through cavities in the vanes, through a chamber in the inner band 14 and radially outwardly through the vanes for return of the cooling medium to an exit port along the outer band. More particularly and by way of example referencing FIG. 1, the outer band 12 includes an outer nozzle wall 18, an outer cover 20 which is disposed over and welded to the outer wall 18 to define a chamber 21 (FIG. 2) therebetween and an impingement plate 22 disposed in the chamber 21. The impingement plate 22 defines with the nozzle segment cover 20 a first cavity 24 and, on an opposite side thereof, defines with the nozzle wall 18 a second cavity 26. Cooling medium inlet and outlet ports 25 and 27, respectively, are provided through the cover for supplying the cooling medium, e.g., steam, to the nozzle vane segment and exhausting the spent cooling steam from the segment. The cooling steam is supplied to the first cavity 24 for passage through a plurality of apertures 30 in the impingement plate 22 for impingement cooling of the nozzle wall 18. The impingement cooling steam flows from the second cavity 26 into one or more inserts (not shown) in cavities extending through the vane between the outer and inner bands. The vane inserts include a plurality of apertures for impingement cooling of the side walls of the vane. The cooling steam then flows into the chamber of the inner band 14 and particularly into the radial innermost cavity for flow through apertures of an impingement plate in the inner band for impingement cooling the side wall of the inner band. The spent cooling steam then flows through a cavity in the vane and through the exhaust port of the outer band. For a complete description of an embodiment of the foregoing described cooling circuit, reference is made to U.S. Pat. No. 5,634,766, of common assignee, the disclosure of which is incorporated herein by reference.

Figure 2:
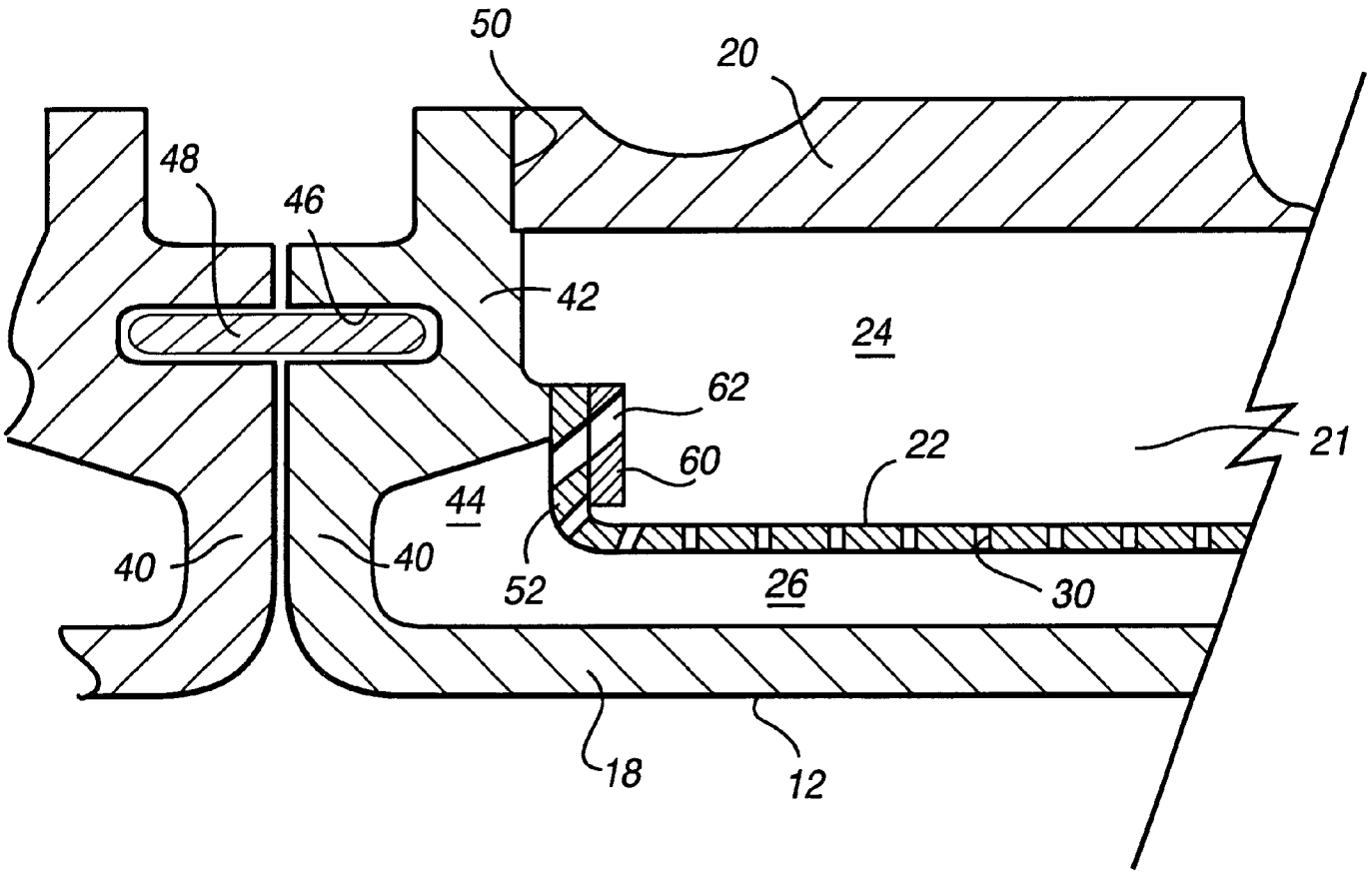
FIG. 2 is an enlarged fragmentary cross-sectional view illustrating a side wall of a nozzle segment and a backing plate and impingement plate for cooling the side wall.

Referring now to FIG. 2, there is illustrated a juncture between adjacent nozzle segments. It will be appreciated that while the following description is specific with reference to the outer band 12, it is equally applicable to the inner band 14. Thus, each nozzle band (both inner and outer bands) includes a nozzle side wall or edge 40 which extends generally radially between the nozzle wall 18 and the cover 20. The band also includes an inturned flange 42 spaced from the nozzle wall 18 and defines with wall 18 and side wall or edge 40 an undercut region 44. The inturned flange 42 also includes a circumferentially opening slot 46 for receiving one edge of a spline 48 forming a seal between adjacent nozzle segments.

As illustrated in FIG. 2, each cover 20 is welded to the inturned flange 42 along opposite edges of the nozzle band. The weld joint 50 lies on the side of the spline seal 48 remote from the nozzle wall 18. By locating the weld joint 50 away from the hot gas path defined in part by nozzle wall 18, the weld joint 50 is subjected to a much lower temperature than if located closer to the hot gas path. Also illustrated in FIG. 2 is the impingement plate 22 which has an flange or turned edge 52 along each of its margins. The turned edge 52 is brazed or welded to an inside surface of the inturned flange 42. While apertures 30 are located in each turned edge 52 of the impingement plate 22, it will be appreciated that there is a substantial distance between the nearest aperture 30 and the side wall or edge 40 in the undercut region 44. This large distance diminishes the cooling effectiveness of the cooling medium flowing through the apertures of the turned flange 52.

To afford effective impingement cooling of the side wall 40 along the undercut region, a backing plate 60 is provided along one side of the turned edge 52 of the impingement plate 22. The backing plate 60 is preferably secured to the impingement plate's turned flange 52 prior to securing the impingement plate 22 to the nozzle segment 10. With the backing plate 60 in place, apertures 62 are formed through the combined backing plate 60 and turned edge 52 and which aligned apertures are directed toward or focused upon the side wall 40. By increasing the length-to-diameter ratio of the apertures 62 for flowing cooling medium, e.g., steam, from the first cavity 24 into the second cavity 26 by applying the backing plate 60, the flow through these longer apertures 62 is directed or targeted on the side walls 40 of the nozzle segments. Instead of the cooling medium pattern spreading out, for example, in a conical spray pattern, the cooling medium remains concentrated and focused and coherently traverses the distance between turned edge 52 and side wall 40 to direct the cooling medium onto and thereby effectively cool the side wall. As indicated in FIG. 2, the length-to-diameter ratio of aligned openings 62 is in excess of the length-to-diameter ratio of apertures 30.

Preferably, the backing plate 60 is applied to the turned edge 52 of the impingement plate 22, for example, by welding, prior to attachment of the impingement plate to the nozzle segment. In this manner, aligned apertures 62 through the backing plate 60 and the turned edge 52 of the impingement plate 22 can be formed simultaneously. The impingement plate 22 can then be placed into the nozzle segment and welded or brazed to inturned flange 42 of the nozzle side wall 40. It will be appreciated that this arrangement is applicable to both the inner and outer bands of the nozzle segment.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For use in a gas turbine, a nozzle segment having outer and inner band portions and at least one vane extending between said band portions, at least one of said band portions having a nozzle wall defining in part a hot gas path through the turbine, a cover radially spaced from said nozzle wall defining a chamber therebetween and an impingement plate secured within said segment and disposed in said chamber defining with said cover a first cavity on one side thereof for receiving a cooling medium, said impingement plate on an opposite side thereof defining with said nozzle wall a second cavity, said impingement plate having a plurality of apertures therethrough for flowing cooling medium from said first cavity into said second cavity for impingement cooling said nozzle wall, said nozzle segment including a side wall extending generally radially between said nozzle wall and said cover and having an inturned flange, said inturned flange defining an undercut region adjacent said side wall, and a backing plate overlying a portion of said impingement plate, said backing plate and said impingement plate portion having aligned apertures therethrough for directing a flow of the cooling medium onto said side wall for impingement cooling thereof.

2. A nozzle segment according to claim 1 wherein said aligned apertures have length-to-width ratios in excess of the length-to-width ratios of the apertures through portions of the impingement plate not overlaid by the backing plate.

3. A nozzle segment according to claim 1 wherein said impingement plate has a turned edge secured to said inturned flange of said side wall, said backing plate extending along said turned edge of said impingement plate.

4. A nozzle segment according to claim 3 wherein said backing plate lies in said first cavity.

5. A nozzle segment according to claim 3 wherein said turned edge of said impingement plate and said backing plate extend generally in a radial direction.

6. A nozzle segment according to claim 1 wherein said nozzle side wall and said cover are welded to one another at a weld joint on a side of said backing plate remote from said side wall.

7. A nozzle segment according to claim 1 wherein said side wall has a slot opening outwardly of said segment for receiving a spline seal, said side wall and said cover being welded to one another at a weld joint outwardly of said slot.

8. A nozzle segment according to claim 1 wherein said one band portion comprises an outer band of said nozzle segment.

9. A nozzle segment according to claim 1 wherein said one band portion comprises an inner band of said nozzle segment.

* * * * *